US009847586B2

(12) United States Patent
Suso

(10) Patent No.: US 9,847,586 B2
(45) Date of Patent: Dec. 19, 2017

(54) METAL TERMINAL FITTING CRIMPED TO A FOLDED END PORTION OF A BRAIDED WIRE

(71) Applicant: Sumitomo Wiring Systems, Ltd., Yokkaichi, Mie (JP)

(72) Inventor: Sadamichi Suso, Mie (JP)

(73) Assignee: Sumitomo Wiring Systems, Ltd., Yokkaichi, Mie (JP)

( * ) Notice: Subject to any disclaimer, the term of this patent is extended or adjusted under 35 U.S.C. 154(b) by 0 days.

(21) Appl. No.: 15/427,739

(22) Filed: Feb. 8, 2017

(65) Prior Publication Data

US 2017/0237183 A1 Aug. 17, 2017

(30) Foreign Application Priority Data

Feb. 15, 2016 (JP) ..... 2016-025565

(51) Int. Cl.

| | |
|---|---|
| ***H01R 9/05*** | (2006.01) |
| ***H01R 4/18*** | (2006.01) |
| ***H01R 4/20*** | (2006.01) |
| ***H01R 43/033*** | (2006.01) |
| ***H01R 43/048*** | (2006.01) |

(52) U.S. Cl.

CPC ..... *H01R 4/183* (2013.01); *H01R 4/20* (2013.01); *H01R 9/0518* (2013.01); *H01R 43/033* (2013.01); *H01R 43/048* (2013.01)

(58) Field of Classification Search

CPC ..... H01R 4/20; H01R 4/183; H01R 43/033; H01R 43/048; H01R 9/0518

USPC ..... 439/585, 877, 878, 884

See application file for complete search history.

(56) References Cited

U.S. PATENT DOCUMENTS

| | | | | |
|---|---|---|---|---|
| 7,066,772 | B2 * | 6/2006 | Takahashi | H01R 9/032 439/731 |
| 7,597,596 | B2 * | 10/2009 | Watanabe | H01R 4/183 439/877 |
| 7,828,612 | B2 * | 11/2010 | Kumakura | H01R 4/185 439/877 |
| 7,938,699 | B2 * | 5/2011 | Okano | H01R 4/185 439/877 |
| 8,246,394 | B2 * | 8/2012 | Ono | H01R 4/185 439/877 |
| 8,277,249 | B2 * | 10/2012 | Koga | H01R 4/185 29/867 |
| 8,317,553 | B2 * | 11/2012 | Nishide | H01R 13/05 439/884 |
| 9,022,821 | B2 * | 5/2015 | Matsushita | H01R 4/185 439/879 |
| 2015/0075863 | A1 | 3/2015 | Suso | |

FOREIGN PATENT DOCUMENTS

JP 2015060632 A 3/2015

* cited by examiner

*Primary Examiner* — Chandrika Prasad
(74) *Attorney, Agent, or Firm* — Reising Ethington, P.C.

(57) ABSTRACT

An electrical wire with a terminal fitting that can be manufactured without using a welding device, and a method of manufacturing this electrical wire with a terminal fitting. Metal foil is wrapped around end portions of the braided wire, and terminal fittings are connected to the end portions. According to this configuration, the metal foil makes it possible to prevent strands in the end portions of the braided wire from becoming loose and spreading apart, and this makes it possible to manufacture the electrical wire with a terminal fitting without using a welding device.

5 Claims, 3 Drawing Sheets

METAL TERMINAL FITTING CRIMPED TO A FOLDED END PORTION OF A BRAIDED WIRE

This application claims the benefit of Japanese Application No. JP2016-025565, filed on Feb. 15, 2016, the contents of which are hereby incorporated by reference in their entirety.

FIELD

The present invention relates to an electrical wire with a terminal fitting and a method of manufacturing the electrical wire with a terminal fitting.

BACKGROUND

Conventionally, an electrical wire with a terminal fitting is known in which a terminal fitting is crimped to the end portion of a braided wire. The braided wire is formed by braiding a large number of metal strands, and is cut to a predetermined length. One end portion of the braided wire is set in a barrel portion of the terminal fitting, and then barrel pieces are crimped.

Incidentally, the strands in the end portion of the braided wire easily become loose and spread apart. When the strands in the end portion of the braided wire become loose, the tensile strength can decrease due to the strands becoming pinched between the barrel pieces of the terminal fitting, and concerns arise such as the contact resistance becoming unstable when the strands spread apart in the braided wire. In view of this, a technique is known in which the end portion of the braided wire is provided with a crimping portion obtained by welding the strands using a resistance welder, as disclosed in JP 2015-60632A. The strands become bonded and consolidated together in the crimping portion, thus making it possible to prevent the strands from becoming loose and spreading apart.

However, in the configuration described above, a welding device is used in order to form the crimping portion, thus making it likely for the equipment cost to become expensive and for manufacturing cost to rise.

SUMMARY

The present design was achieved in light of the circumstances described above, and an object is to provide an electrical wire with a terminal fitting that can be manufactured without using a welding device, and a method of manufacturing this electrical wire with a terminal fitting.

An electrical wire with a terminal fitting according to one aspect of the present design includes: a metal foil; a braided wire; and a terminal fitting, wherein the metal foil is wrapped around an end portion of the braided wire, and the terminal fitting is connected to an outer side of the wrapped metal foil.

A method of manufacturing an electrical wire with a terminal fitting according to one aspect of the present design includes: a cutting step of cutting a braided wire; a wrapping step of wrapping a metal foil around the braided wire; and a terminal connection step of connecting the terminal fitting to an end portion of the braided wire that is wrapped with the metal foil.

According to the present design, the loosening and spreading apart of strands in the end portion of the braided wire can be prevented by the metal foil, thus making it possible to manufacture the electrical wire with a terminal fitting without using a welding device.

DRAWINGS

Figure 1:
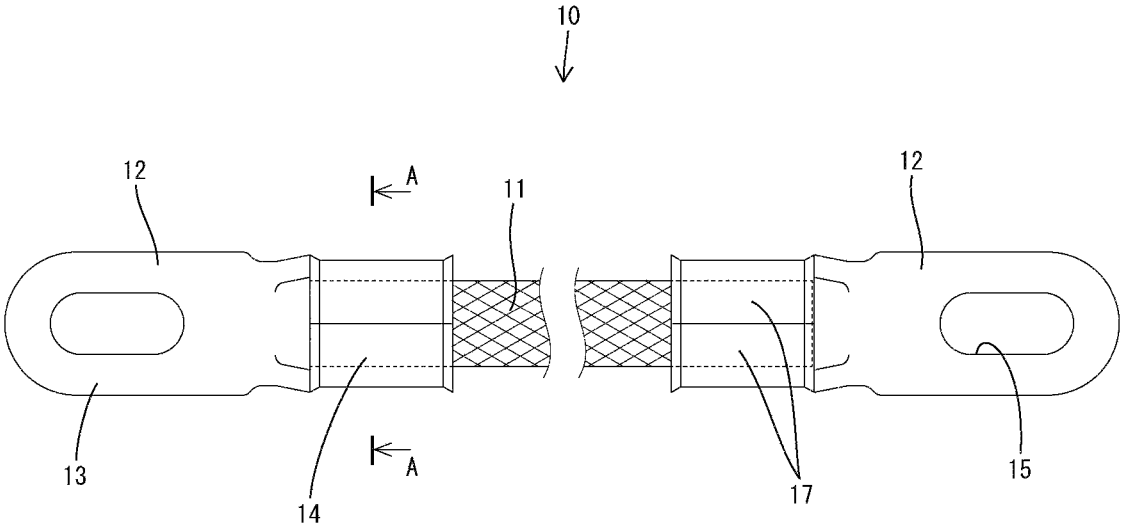
Figure 2:
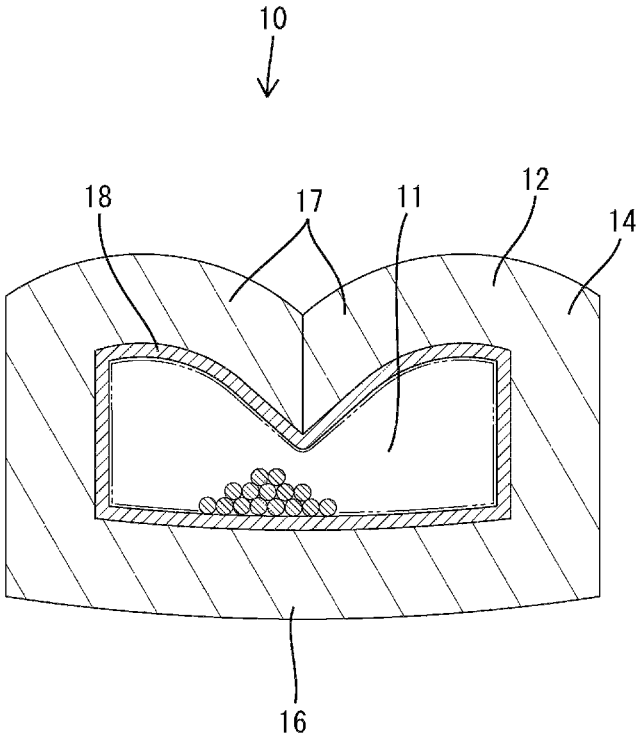
Figure 3A:
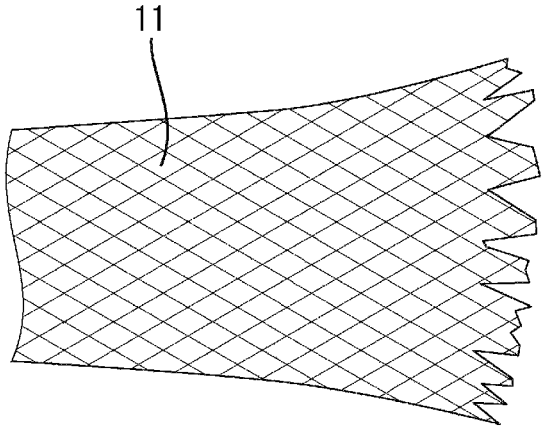
Figure 3B:
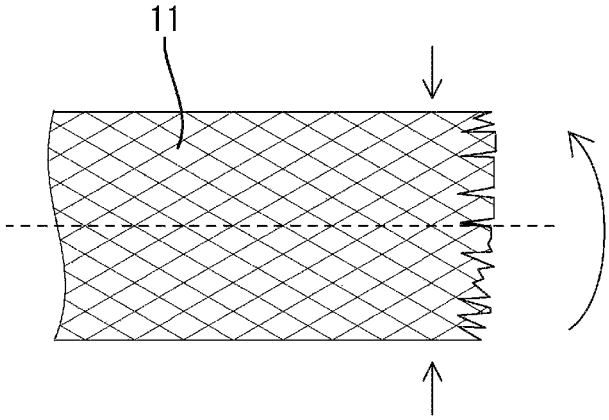
Figure 3C:
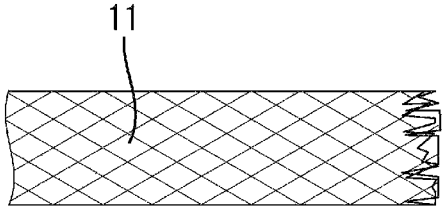
Figure 3D:
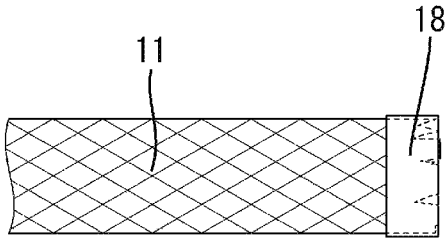

FIG. 1 is a plan view of an electrical wire with a terminal fitting according to a first embodiment;

FIG. 2 is a cross-sectional view of a state in which a barrel portion has been crimped to an end portion of a braided wire, and is a cross-sectional view that corresponds to a cross section taken at position A-A in FIG. 1; and FIGS. 3A to 3D are schematic views of the end portion of the braided wire in some steps for manufacturing the electrical wire with a terminal fitting, where FIG. 3A is a schematic view of a state after cutting, FIG. 3B is a schematic view of the folding over of a group of strands, FIG. 3C is a schematic view of the folded over state, and FIG. 3D is a schematic view of a state in which metal foil has been wrapped around the end portion.

DESCRIPTION

Preferred embodiments will be described below.

In the electrical wire with a terminal fitting according to another aspect of the present design, an end portion of the braided wire may be folded over onto itself.

In the method of manufacturing an electrical wire with a terminal fitting according to another aspect of the present design, the wrapping step of wrapping the metal foil around the end portion of the braided wire may be performed after the cutting step. According to this method, the braided wire is cut in a state of not being wrapped with the metal foil, thus making it possible to cut the braided wire more easily than in the case of cutting a portion that is wrapped with the metal foil.

In the method of manufacturing an electrical wire with a terminal fitting according to another aspect of the present design, in the wrapping step, the metal foil may be wrapped around a cutting target portion of the braided wire, and in the cutting step performed thereafter, the cutting target portion may be cut in a state of being wrapped with the metal foil. According to this method, it is possible to improve productivity through the use of an automatic machine.

Also, in the method of manufacturing an electrical wire with a terminal fitting according to another aspect of the present design, a folding step of folding over the end portion of the braided wire onto itself may be performed after the cutting step. According to this method, the braided wire is cut in the state of not being folded over (the state in which the thickness is smaller than that of the braided wire when folded), thus making it possible to easily cut the braided wire.

First Embodiment

Hereinafter, a first embodiment of the present design will be described in detail with reference to FIGS. 1 to 3D.

An electrical wire with a terminal fitting 10 of the present embodiment includes a braided wire 11 and a pair of terminal fittings 12 that are connected to the two lengthwise end portions of the braided wire 11.

The terminal fittings 12 are each formed by performing presswork on a plate material that is made of a metal that has excellent electrical conductivity (e.g., a copper alloy). The terminal fittings 12 each have a connection portion 13 for connection to a device or the like, and a barrel portion 14 for connection to an end portion of the braided wire 11, and the connection portion 13 and the barrel portion 14 are integrated with each other. A through-hole 15, into which a fastening member (not shown) such as a bolt can be inserted, is formed in the connection portion 13 and passes through the connection portion 13 in the plate thickness direction. The through-hole 15 is an elongated hole that is elongated in the lengthwise direction of the braided wire 11.

The barrel portion 14 includes a bottom plate 16 that extends in one direction from the connection portion 13 and is flush with the same, and a pair of barrel pieces 17 that extend from the two widthwise side edges of the bottom plate 16. The terminal fitting 12 is connected to the end portion of the braided wire 11 by crimping the pair of barrel pieces 17 to the end portion of the braided wire 11.

The braided wire 11 is tubular, and is formed by multiple (approximately 6,000 in the present embodiment) highly electrically conductive metal strands being braided into a mesh (net). The braided wire 11 has favorable flexibility. The metal strands are made of a copper-based metal, and are plated with tin on the surface. The end faces of the braided wire 11 are cut faces.

The end portions of the braided wire 11 are each folded over onto itself in the width direction. As shown in FIG. 3B, each end portion of the braided wire 11 is folded in two at the center of the width direction and laid on itself to form two layers. Accordingly, the end portion of the braided wire 11 has half the width of an intermediate portion in the lengthwise direction of the braided wire 11, and twice the thickness thereof.

As shown in FIG. 3D, a piece of metal foil 18 is wrapped around the end portion of the braided wire 11.

The metal foil 18 is adhesive copper foil for example, and an electrically conductive adhesive or the like has been applied to either the upper or lower surface.

The metal foil 18 is obtained by cutting metallic tape, which is elongated in one direction, to a predetermined length.

The metal foil 18 has a length according to which it can encompass at least the entire outer circumference of the end portion of the braided wire 11. The metal foil 18 has a width according to which it can encompass a predetermined range in the lengthwise direction from the cut face of the braided wire 11.

The metal foil 18 is wrapped around the end portion of the braided wire 11 that has been folded over. Portions of the inner surface of the folded-over braided wire 11 are in contact with each other.

Next, one example of a method of manufacturing the electrical wire with a terminal fitting 10 of the present embodiment will be described.

First, a cutting step is performed in which the braided wire 11 is cut. The cutting step is performed in the state in which the braided wire 11 is not folded over in the width direction (the state in which the braided wire 11 is spread out flat in the width direction). The braided wire 11 is cut at a predetermined position by a cutter device (not shown), thus giving the braided wire 11 a predetermined length. As shown in FIG. 3A, the strands easily become loose and spread apart in the end portion of the cut braided wire 11.

Next, a folding step is performed in which the end portion of the cut braided wire 11 is folded over onto itself. As shown in FIG. 3B, the end portion of the braided wire 11 is folded in two at the center in the width direction and laid on itself while keeping the loosened strands in a group.

Next, a wrapping step is performed in which the metal foil 18 is wrapped around the end portion of the braided wire 11. As shown in FIG. 3D, the metal foil 18, which has been cut to a predetermined length, is wrapped around and adhered to the entire circumference of the end portion of the braided wire 11. The wrapping step of wrapping the metal foil 18 is performed manually. In the end portion of the braided wire 11 that is wrapped with the metal foil 18, the strands are held in a grouped state and are not loose. In the present embodiment, the folding step and the wrapping step are performed in the stated order on each of the two ends of the braided wires 11.

Next, a terminal connection step is performed in which the terminal fitting 12 is connected to the end portion of the braided wire 11. The end portion of the braided wire 11 is set inside the barrel portion 14. The entirety of the portion of the end portion of the braided wire 11 that is wrapped with the metal foil 18 is arranged inside the barrel portion 14. Either the upper or lower surface of the end portion of the braided wire 11 is placed on the bottom plate 16, one end of the braided wire 11 in the width direction is positioned at the base of one of the barrel pieces 17, and the other end is placed at the base of the other barrel piece 17. When the barrel portion 14 is pressed by a crimping device (not shown), the leading ends of the pair of barrel pieces 17 abut against each as shown in FIG. 2, and thus the barrel portion 14 encompasses and is crimped to the end portion of the braided wire 11. The end portion of the braided wire 11 in the folded over state is crimped by the barrel portion 14, and therefore portions of the inner side of the braided wire 11 come into close contact with each other. In the present embodiment, the terminal connection step is performed in the stated order on each of the two end portions of the braided wire 11.

The manufacturing of the electrical wire with a terminal fitting 10 is thus complete.

Next, actions and effects of the present embodiment having the above configuration will be described.

In the electrical wire with a terminal fitting 10 of the present embodiment, the metal foil 18 is wrapped around the end portions of the braided wire 11, and the terminal fittings 12 are connected to the end portions. According to this configuration, the loosening and spreading apart of strands in the end portions of the braided wire 11 can be prevented by the metal foil 18, and this makes it possible to manufacture the electrical wire with a terminal fitting 10 without using a welding device.

Also, in the case where loosening in the end portions of the braided wire 11 is prevented by soldering for example, there is a concern that the solder will penetrate into the braided wire 11 and cause the braided wire 11 to harden, thus degrading the flexibility of the braided wire 11. However, according to the present embodiment, the loosening and spreading apart of strands in the end portions of the braided wire 11 can be prevented by the metal foil 18, thus making it possible to prevent the aforementioned situation. Furthermore, the metal foil 18 is bendable, thus making it possible to improve connection reliability between the braided wire 11 and the terminal fittings 12.

Also, the cutting step of cutting the braided wire 11 is performed, and thereafter the wrapping step of wrapping the metal foil 18 around the end portion of the cut braided wire 11 is performed. According to this method, the braided wire 11 is cut in the state of not being wrapped with the metal foil 18, thus making it possible to cut the braided wire 11 more easily than in the case of cutting a portion that is wrapped with the metal foil 18.

Also, after the cutting step, the folding step is performed in which the end portion of the cut braided wire 11 is folded over onto itself in the width direction. According to this method, the braided wire 11 is cut in the state of not being folded over (the state in which the thickness is smaller than that of the braided wire 11 when folded), thus making it possible to easily cut the braided wire 11.

Second Embodiment

Next, a method of manufacturing the electrical wire with a terminal fitting 10 according to a second embodiment of the present design will be described.

The method of manufacturing the electrical wire with a terminal fitting 10 according to the present embodiment is different from that of the first embodiment in that a wrapping step is performed in which the metal foil 18 is wrapped around a cutting target portion of the braided wire 11, and thereafter a cutting step is performed in which the cutting target portion, which is wrapped with the metal foil 18, is cut. Note that configurations similar to those in the first embodiment are denoted by the same reference signs, and redundant descriptions will not be given for them.

Similarly to the first embodiment, in the electrical wire with a terminal fitting 10 of the present embodiment, pieces of metal foil 18 are wrapped around the end portions of the braided wire 11, the terminal fittings 12 are connected to the end portions, and the end portions of the braided wire 11 are each folded over onto itself in the width direction.

Next, one example of a method of manufacturing the electrical wire with a terminal fitting 10 of the present embodiment will be described.

First, a wrapping step is performed in which the metal foil 18 is wrapped around a cutting target portion of the braided wire 11. Similarly to the first embodiment, the metal foil 18, which has been cut to a predetermined length, is wrapped around and adhered to the entire circumference of the cutting target portion of the braided wire 11. The wrapping step is performed in the state in which the braided wire 11 is not folded over in the width direction (the state in which the braided wire 11 is spread out flat in the width direction).

Next, a cutting step is performed in which the cutting target portion, which is wrapped with the metal foil 18, is cut. The cutting target portion of the braided wire 11 is cut by a cutter device (not shown), thus giving the braided wire 11 a predetermined length. At this time, by performing cutting using a hot cutter, it is possible to increase the fixing force of the braided wire 11 and the metal foil 18. In the end portion of the cut braided wire 11, the strands are wrapped with the metal foil 18 and thus are held in a grouped state in which they do not become loose and spread apart.

Thereafter, a folding step of folding the end portion of the cut braided wire 11 over onto itself, and a terminal connection step of connecting the terminal fitting 12 to the end portion of the braided wire 11 are performed in the stated order, thus completing the manufacturing of the electrical wire with a terminal fitting 10. The barrel portion 14 is crimped to the end portion of the braided wire 11 in the folded state, and thus portions of the metal foil 18 arranged inside the barrel portion 14 come into close contact with each other.

As described above, in the manufacturing method of the present embodiment, by cutting the metal foil 18 and the braided wire 11 at the same time, the spreading of the braided wire 11 after cutting can be suppressed, and it is possible to improve productivity through the use of an automatic machine, and to eliminate the need for the task of grouping together loose strands in the end portions of the braided wire 11.

Other Embodiments

The present invention is not intended to be limited to the embodiments described using the above descriptions and drawings, and embodiments such as the following examples are also encompassed in the technical scope of the present invention.

Although specific examples of the terminal fittings 12 connected to the two end portions of the braided wire 11 are described in the above embodiments, the present invention is not limited to these examples, and various types of terminal fittings can be used.

Although the end portions of the braided wire 11 are folded in two in the above embodiments, the present invention is not limited to this, and the end portions of the braided wire may be folded in three or rounded for example.

Although the end portions of the braided wire 11 are each folded over onto itself in the above embodiments, the present invention is not limited to this, and the end portions of the braided wire may be flattened without being folded over.

Although the end portions of the braided wire 11 are folded in two at the center in the width direction in the above embodiments, the present invention is not limited to this, and the two widthwise edge portions of each end portion of the braided wire may be folded over toward the center.

Although the end portions of the braided wire 11 are folded over in the width direction in the above embodiments, the present invention is not limited to this, and the end portions of the braided wire may be folded over in the axial direction.

Although the wrapping step is performed after the folding step in the first embodiment, the present invention is not limited to this, and the folding step may be performed after the wrapping step.

Although the folding step is performed after the wrapping step in the second embodiment, the present invention is not limited to this, and the wrapping step may be performed after the folding step.

It is to be understood that the foregoing is a description of one or more preferred exemplary embodiments of the invention. The invention is not limited to the particular embodiment(s) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. All such other embodiments, changes, and modifications are intended to come within the scope of the appended claims.

As used in this specification and claims, the terms "for example," "e.g.," "for instance," "such as," and "like," and the verbs "comprising," "having," "including," and their other verb forms, when used in conjunction with a listing of one or more components or other items, are each to be construed as open-ended, meaning that the listing is not to be considered as excluding other, additional components or items. Other terms are to be construed using their broadest reasonable meaning unless they are used in a context that requires a different interpretation.

REFERENCE SIGNS LIST

10: Electrical wire with a terminal fitting
11: Braided wire
12: Terminal fitting
18: Metal foil

The invention claimed is:

1. An electrical wire, comprising:

a metal foil;

a braided wire being made from a plurality of electrically conductive metal strands and having an unfolded intermediate portion and a folded end portion, the folded end portion of the braided wire is folded over onto itself in a width direction so as to have a smaller width than the unfolded intermediate portion of the braided wire; and a metal terminal fitting;

wherein the metal foil is wrapped around and contacts the folded end portion of the braided wire, and the metal terminal fitting is crimped around and contacts the wrapped metal foil such that the folded end portion of the braided wire, the metal foil, and the metal terminal fitting are all electrically connected to one another.

2. A method of manufacturing an electrical wire, comprising:

a cutting step of cutting a braided wire having a plurality of electrically conductive metal strands;

a folding step of folding over an end portion of the braided wire onto itself in a width direction so as to reduce a width of the folded end portion of the braided wire;

a wrapping step of wrapping a metal foil around the folded end portion of the braided wire; and a terminal connection step of crimping a metal terminal fitting around the folded end portion of the braided wire that is wrapped with the metal foil.

3. The method of manufacturing an electrical wire according to claim 2, wherein the wrapping step of wrapping the metal foil around the end portion of the braided wire is performed after the cutting step.

4. The method of manufacturing an electrical wire according to claim 2, wherein in the wrapping step, the metal foil is wrapped around a cutting target portion of the braided wire, and in the cutting step performed thereafter, the cutting target portion is cut in a state of being wrapped with the metal foil.

5. The method of manufacturing an electrical according to claim 2, wherein the folding step of folding over the end portion of the braided wire onto itself is performed after the cutting step.

* * * * *